US010900441B2

(12) United States Patent
Oshita et al.

(10) Patent No.: US 10,900,441 B2
(45) Date of Patent: Jan. 26, 2021

(54) CYLINDER HEAD OF INTERNAL COMBUSTION ENGINE

(71) Applicant: HONDA MOTOR CO., LTD., Tokyo (JP)

(72) Inventors: Toru Oshita, Saitama (JP); Yamato Nakamizo, Saitama (JP); Takuya Miyamura, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 164 days.

(21) Appl. No.: 15/914,023

(22) Filed: Mar. 7, 2018

(65) Prior Publication Data

US 2018/0274476 A1 Sep. 27, 2018

(30) Foreign Application Priority Data

Mar. 22, 2017 (JP) ..... 2017-056332

(51) Int. Cl.
*F02F 1/24* (2006.01)
*F01L 1/047* (2006.01)
(Continued)

(52) U.S. Cl.
CPC ..... *F02F 1/242* (2013.01); *F01L 1/047* (2013.01); *F01L 1/46* (2013.01); *F02F 11/002* (2013.01);
(Continued)

(58) Field of Classification Search
CPC ..... F02F 1/242; F02F 11/002; F01L 1/047; F01L 1/46; F01L 2001/0476; F01L 2001/0537
(Continued)

(56) References Cited

U.S. PATENT DOCUMENTS 4,727,717 A * 3/1988 Ikenoya ..... F01L 3/205 180/219
6,223,709 B1 * 5/2001 Takahashi ..... F01L 1/0532 123/193.5

FOREIGN PATENT DOCUMENTS

AT 001683 U2 9/1997
DE 19808718 A1 9/1999
(Continued)

OTHER PUBLICATIONS

Jul. 23, 2018, European Search Report issued for related EP Application No. 18160636.9.
(Continued)

*Primary Examiner* — Lindsay M Low
*Assistant Examiner* — Omar Morales
(74) *Attorney, Agent, or Firm* — Paratus Law Group, PLLC

(57) ABSTRACT

A cylinder head of an internal combustion engine includes a cylinder head main body which is formed with a main body side plug insertion hole into which an ignition plug is inserted, a cam holder which is fixed to the cylinder head main body and forms cam bearing portions together with the cylinder head main body, wherein the cam bearing portions rotatably support an intake camshaft and an exhaust camshaft, respectively, and wherein the cam holder is formed with a holder side plug insertion hole which communicates with the main body side plug insertion hole and into which the ignition plug is inserted, and a knock pin which is disposed across the main body side plug insertion hole and the holder side plug insertion hole to restrict assembly positions of the cam holder and the cylinder head main body.

6 Claims, 7 Drawing Sheets

(51) Int. Cl.

| | |
|---|---|
| ***F01L 1/46*** | (2006.01) |
| ***F02F 11/00*** | (2006.01) |
| *F01L 1/053* | (2006.01) |
| *F02B 61/02* | (2006.01) |

(52) U.S. Cl.
CPC ..... *F01L 2001/0476* (2013.01); *F01L 2001/0537* (2013.01); *F01L 2303/00* (2020.05); *F02B 61/02* (2013.01)

(58) Field of Classification Search
USPC ..... 123/193.5
See application file for complete search history.

(56) References Cited

FOREIGN PATENT DOCUMENTS

| | | | | |
|---|---|---|---|---|
| DE | 202008005019 | U1 | | 8/2009 |
| EP | 0434638 | A1 | | 6/1991 |
| EP | 2444600 | A1 | | 4/2012 |
| JP | S63-018165 | A | | 1/1988 |
| JP | H07-243347 | A | | 9/1995 |
| JP | 2000-087705 | A | | 3/2000 |
| JP | 3417424 | B2 | | 6/2003 |
| JP | 2004-293469 | A | | 10/2004 |
| JP | 2004293469 | A | * | 10/2004 |
| JP | 2007-291979 | A | | 11/2007 |
| JP | 2011-208546 | A | | 10/2011 |
| JP | 2011-241700 | A | | 12/2011 |
| WO | WO 2008/029247 | A1 | | 3/2008 |

OTHER PUBLICATIONS

Nov. 24, 2020, Japanese Office Action issued for related JP Application No. 2017-056332.

* cited by examiner

CYLINDER HEAD OF INTERNAL COMBUSTION ENGINE

CROSS-REFERENCE TO RELATED APPLICATIONS

The present application claims the benefit of priority of Japanese Patent Application No. 2017-056332, filed on Mar. 22, 2017, the content of which is incorporated herein by reference.

TECHNICAL FIELD

The present invention relates to a cylinder head of an internal combustion engine.

BACKGROUND ART

As a cylinder head of an internal combustion engine, for example, JP-A-2000-87705 discloses a cam holder in which a holder for an intake side cam and a holder for an exhaust side cam are integrally connected. In such a cam holder, in order to prevent positional shift when fastening the cam holder to a cylinder head, the cam holder is connected to the cylinder head with a knock pin interposed therebetween on joining surfaces. As the size of the cam holder increases as disclosed in JP-A-2000-87705, there is a possibility that dimensional errors at the time of processing accumulate over the entire part and the positional shift becomes large depending on the portion. JP-A-2011-241700 discloses that a knock pin is disposed on the periphery of a bolt which holds a camshaft to prevent positional shift.

In an engine in which a plug hole is provided between an intake camshaft and an exhaust camshaft, when an included angle of the intake and exhaust valves is narrowed in order to change the shape of a combustion chamber or an outer diameter of the valve, the thickness between the plug insertion hole and one pair of bolts sandwiching the plug insertion hole therebetween becomes small. In this case, there is no sufficient space for disposing the knock pins, and a new countermeasure against the positional shift is required.

SUMMARY

The present invention has been made in view of the above circumstances, and an object thereof is to provide a cylinder head of an internal combustion engine which is capable of preventing positional shift at the time of assembly even in a case where there is no sufficient space for disposing a knock pin on the periphery of a bolt.

(1) According to an embodiment of the present invention, there is provided a cylinder head of an internal combustion engine including:

a cylinder head main body which is formed with a main body side plug insertion hole into which an ignition plug is inserted;

a cam holder which is fixed to the cylinder head main body and forms cam bearing portions together with the cylinder head main body, wherein the cam bearing portions are configured to rotatably support an intake cam shaft and an exhaust cam shaft, respectively, which are disposed to sandwich the main body side plug insertion hole, and wherein the cam holder is formed with a holder side plug insertion hole which communicates with the main body side plug insertion hole and into which the ignition plug is inserted; and a knock pin which is disposed across the main body side plug insertion hole and the holder side plug insertion hole to restrict assembly positions of the cam holder and the cylinder head main body.

(2) In the cylinder head of (1), the knock pin may be a tubular member which is provided integrally with the cam holder to extend from a cylinder head side end portion of the holder side plug insertion hole.

(3) In the cylinder head of (2), the knock pin may be formed integrally with the cam holder.

(4) In the cylinder head of (2), the knock pin may be formed as a separate member from the cam holder and may be integrated with the cam holder by being press-fitted into the holder side plug insertion hole of the cam holder.

(5) In the cylinder head of any one of (1) to (4), the internal combustion engine may be a multi-cylinder engine, the cylinder head main body may be formed with a plurality of main body side plug insertion holes into which ignition plugs corresponding to respective cylinders are inserted, the cam holder may be formed with a plurality of the holder side plug insertion holes which respectively communicate with the main body side plug insertion hole of the cylinder head main body and into which the ignition plugs are inserted, respectively, the cam holder may be integrated for at least one pair of adjacent cylinders, and the knock pin may be provided across the main body side plug insertion hole and the holder side plug insertion hole in the integrated cam holder.

(6) In the cylinder head of (5), the cylinder head main body may be formed with a main body side air passage between adjacent main body side plug insertion holes, the cam holder may be formed with a holder side air passage which communicates with the main body side air passage, the cylinder head may further include another knock pin which is disposed across the main body side air passage and the holder side air passage to restrict the assembly positions of the cam holder and the cylinder head main body.

(7) The cylinder head of any one of (1) to (6) may further include:

a seal member which has a rectangular section and is disposed at an outer circumference of the knock pin to seal a gap between the cylinder head main body and the cam holder.

(8) In the cylinder head of (7), the cylinder head main body may be formed with a main body side air passage between adjacent main body side plug insertion holes, the cam holder may be formed with a holder side air passage which communicates with the main body side air passage, the cylinder head may further include another knock pin which is disposed across the main body side air passage and the holder side air passage to restrict the assembly positions of the cam holder and the cylinder head main body, and the seal member may be integrally formed with a seal member which is disposed at an outer circumference of the other knock pin to seal a gap between the cam holder and the cylinder head main body.

Advantageous Effects

According to the configuration of (1), since the knock pin to restrict the assembly positions of the cam holder and the cylinder head main body is disposed across the main body side plug insertion hole and the holder side plug insertion hole into which the ignition plug is inserted, even in a case where there is no sufficient space for providing the knock pin on the periphery of the bolt for assembling the cam holder and the cylinder head main body, it is possible to prevent the positional shift by restricting the position at the time of assembling of the cam holder and the cylinder head main body.

According to the configuration of (2), since the knock pin is a cylindrical member integrally provided with the cam holder to extend from the cylinder head side end portion of the holder side plug insertion hole, it is possible to omit attaching or detaching work of the knock pin at the time of assembling or detaching the cam holder to and from the cylinder head main body, and to improve workability of assembling and detaching the cam holder to and from the cylinder head main body.

According to the configuration of (3), since the knock pin is formed integrally with the cam holder, assembly of the knock pin is unnecessary, and it is possible to reduce the number of components.

According to the configuration of (4), since the knock pin which is formed as a separate member is press-fitted into the holder side plug insertion hole of the cam holder and is integrated with the cam holder, even when the shape of the cam holder is made different, by preparing general-purpose knock pins, the knock pin can also be employed in other models.

According to the configuration of (5), since the internal combustion engine is a multi-cylinder engine, the cam holder is integrated for at least one pair of adjacent cylinders, and the knock pin is provided across the main body side plug insertion hole and the holder side plug insertion hole in the integrated cam holder, it is possible to prevent the positional shift of the entire cam holder with the plurality of knock pins disposed side by side at the center of the cam holder. In addition, by integrating the cam holder, it is possible to reduce the number of cam holders.

According to the configuration of (6), the cylinder head main body is formed with a main body side air passage between adjacent main body side plug insertion holes, the cam holder is formed with a holder side air passage which communicates with the main body side air passage, the cylinder head further include another knock pin which is disposed across the main body side air passage and the holder side air passage to restrict the assembly positions of the cam holder and the cylinder head main body. Therefore, it is possible to improve positional shift prevention performance.

According to the configuration of (7), since the cylinder head further includes a seal member which has a rectangular section and is disposed at an outer circumference of the knock pin to seal the gap between the cylinder head main body and the cam holder, the seal member is compressed and deformed at the time of assembling the cam holder and tightly adheres to the outer circumferential surface of the knock pin, and accordingly, it is possible to ensure sealing performance.

According to the configuration of (8), since the seal member provided at the outer circumference of the knock pin provided on a secondary air passage side and the seal member provided at the outer circumference of the knock pin provided on the plug insertion hole side are integrally formed, in addition to the reduction in number of components of the seal member, it is possible to mount the seal member simultaneously at two locations at the time of assembly work, and thereby improving workability.

DESCRIPTION OF EMBODIMENTS

Hereinafter, a cylinder head of an internal combustion engine according to an embodiment of the invention will be described with reference to FIGS. 1 to 8.

Figure 1:
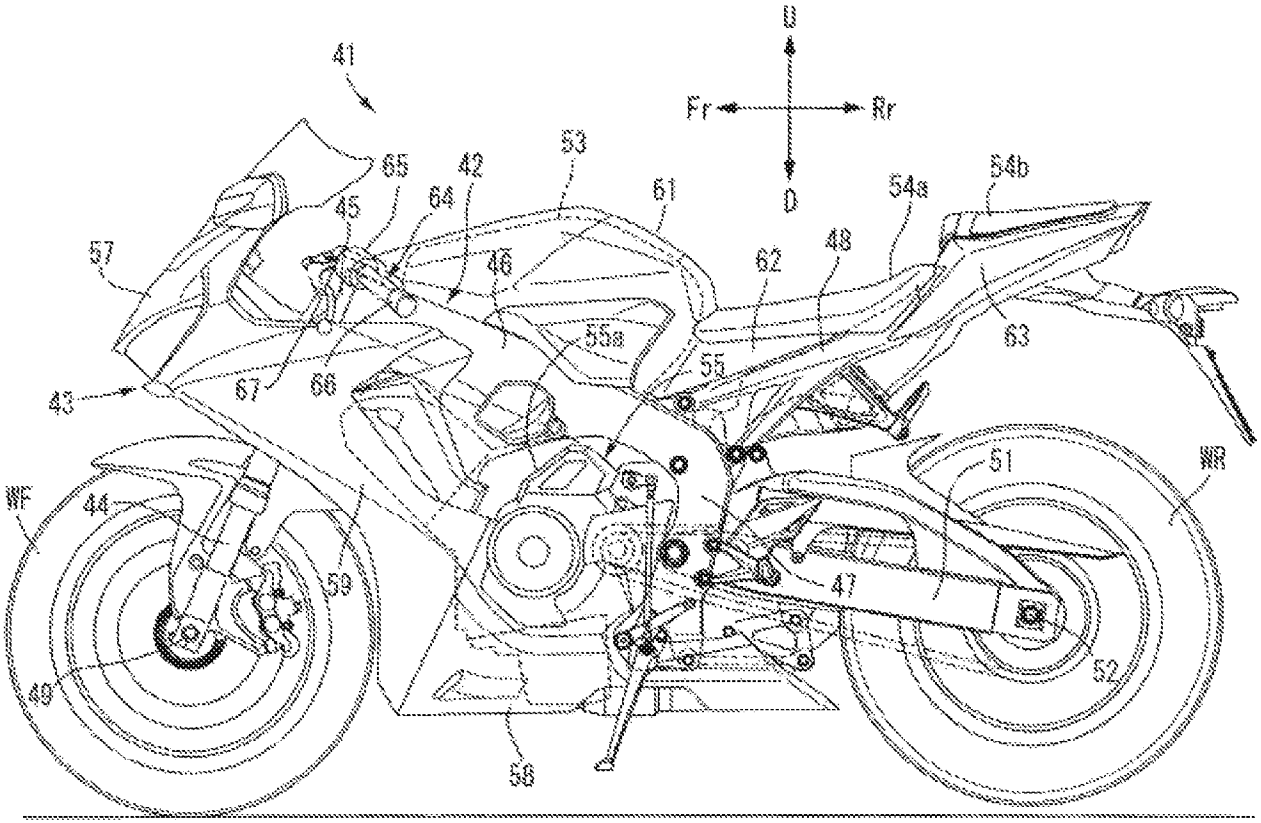
FIG. 1 is a left side view of a motorcycle including a cylinder head of an internal combustion engine according to an embodiment of the invention.
Figure 2:
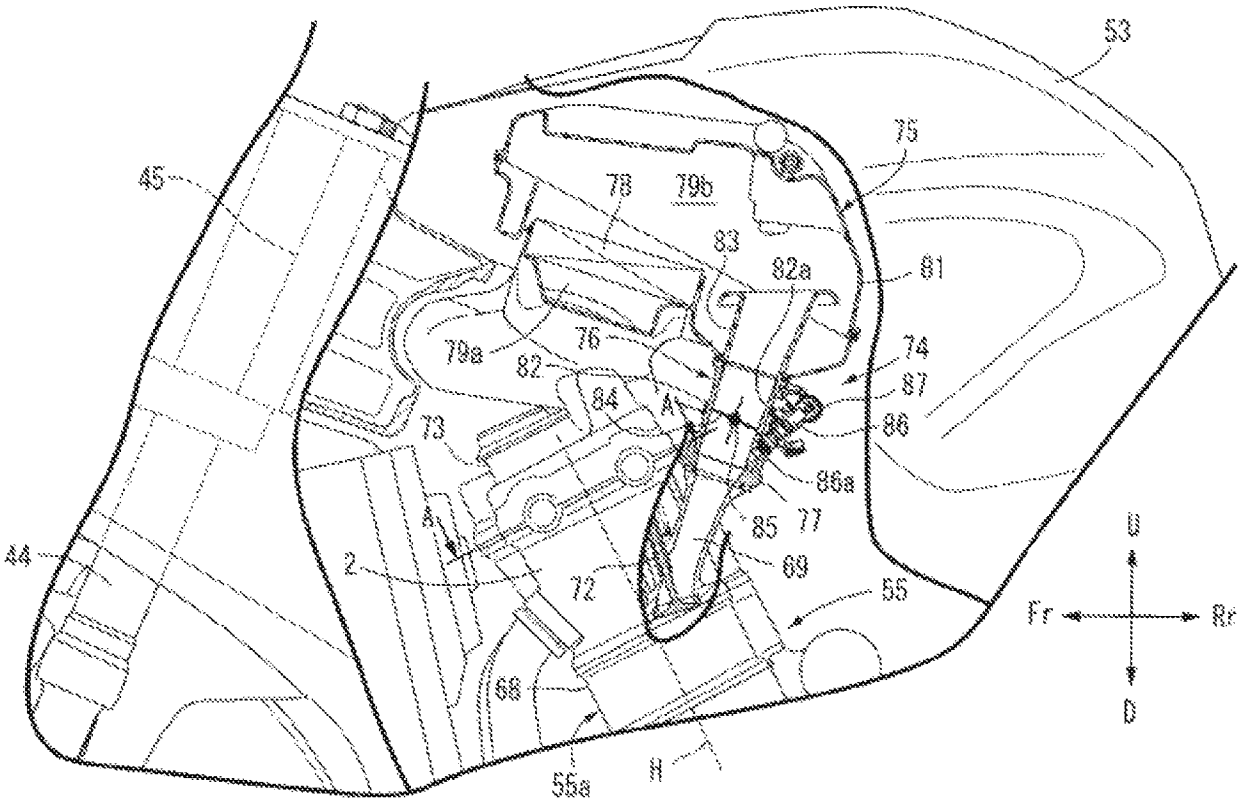
FIG. 2 is an enlarged schematic view illustrating the periphery of the internal combustion engine by breaking a part of the motorcycle illustrated in FIG. 1.

First, a motorcycle including a cylinder head of an internal combustion engine according to an embodiment of the invention will be described with reference to FIGS. 1 and 2. FIG. 1 is a left side view of the motorcycle including the cylinder head of the internal combustion engine according to an embodiment of the invention, and FIG. 2 is an enlarged sectional view illustrating the periphery of the internal combustion engine by breaking a part of the motorcycle illustrated in FIG. 1. The drawings are viewed in orientations of symbols, and in FIGS. 1 and 2, the front and rear, the left and right, and the top and bottom are described according to the direction viewed from an operator, and a front part of a vehicle is Fr, a rear part is Rr, an upper part is U, and a lower part is D in the drawing.

In FIG. 1, a motorcycle 41 includes a vehicle body frame 42 and a cowl cover 43 mounted on the vehicle body frame 42. The body frame 42 includes a head pipe 45 which steerably supports a front fork 44; one pair of left and right main frames 46 and 46 which extends rearward and downward from the head pipe 45; and one pair of left and right pivot frames 47 and 47 which extends downward from rear ends of the main frames 46 and 46; and one pair of left and right seat rails 48 and 48 which extends rearward and upward from the rear ends of the main frames 46 and 46. The front fork 44 supports a front wheel WF so as to freely rotate around an axle 49. A front end of a swing arm 51 is linked to the pivot frames 47 and 47 to be capable of vertically swinging. At the rear end of the swing arm 51, a rear wheel WR is rotatably supported around an axle 52. A fuel tank 53 is mounted on the main frame 46 from above. A front riding seat 54*a* and a rear riding seat 54*b* are supported on the seat rail 48 at the rear part of the fuel tank 53 in order.

An engine main body 55*a* of the internal combustion engine 55 is supported on the vehicle body frame 42 below the fuel tank 53. The internal combustion engine 55 is linked to the main frame 46 and the pivot frame 47. The internal combustion engine 55 exerts power for generating a rotational force of the rear wheel WR. Fuel is supplied from the fuel tank 53 to the internal combustion engine 55.

The cowl cover 43 includes a front cowl 57 which is supported by the vehicle body frame 42 above the front wheel WF, and covers the head pipe 45 from the front; a lower cowl 58 which is supported by the vehicle body frame 42 between the front wheel WF and the rear wheel WR, and covers the engine main body 55*a* from below; and a center cowl 59 which connects the front cowl 57 and the lower cowl 58 to each other continuously from the front cowl 57 and the lower cowl 58, and partially covers the side of the engine main body 55*a*. The fuel tank 53 is covered with a tank cover 61. On the tank cover 61, one pair of left and right side covers 62 which covers a lower portion on the rear side of the fuel tank 53 from both of the left and right sides is continuous between the fuel tank 53 and the front riding seat 54*a*. The seat rail 48 is covered with the rear cowl 63 below the rear riding seat 54*b*.

A steering handle 64 is coupled to the front fork 44. The steering handle 64 is provided with a bar handle 65 which extends leftward and rightward from the head pipe 45 in a direction parallel to the axle 49. A left handle grip 66 and a clutch lever 67 are provided at a left end of the bar handle 65. At a right end of the bar handle 65, a grip unit including a right handle grip (not illustrated) and a brake lever are provided.

In FIG. 2, the engine main body 55*a* includes a cylinder block 68 having four cylinders (refer to FIG. 3); a cylinder head 2 which is coupled to the cylinder block 68 to partition an intake port 69 that communicates with a combustion chamber for each cylinder; and a head cover 73 which is provided with a valve mechanism 72 for opening and closing the intake port 69 with respect to the combustion chamber between the cylinder heads 2. Here, a cylinder axial line H is inclined forward, and the intake port 69 is formed in the cylinder head 2 so as to extend obliquely upward and rearward.

An intake system 74 is connected to the cylinder head 2. The intake system 74 includes: an air cleaner 75 which is covered with a fuel tank 53 and is disposed above the head cover 73; an electronic control type throttle device 76 having an upstream end connected to the air cleaner 75; and an insulator 77 which couples the downstream end of the electronic control type throttle device 76 to the head cover 73. The air cleaner 75 includes a cleaner case 81 which houses the cleaner element 78 and defines a non-purification chamber 79*a* and a purification chamber 79*b* which are separated from each other by the cleaner element 78.

The electronic control type throttle device 76 includes a throttle body 82. The throttle body 82 partitions an intake passage 82*a* for each of the cylinders. The upstream end of the intake passage 82*a* is connected to the cleaner case 81 through an air funnel 83 which enters the purification chamber 79*b*. The downstream end of the intake passage 82*a* is connected to the intake port 69 of the cylinder head 2. In FIG. 2, a reference numeral 84 denotes a throttle valve, and a reference numeral 86 denotes a fuel injection valve.

Figure 3:
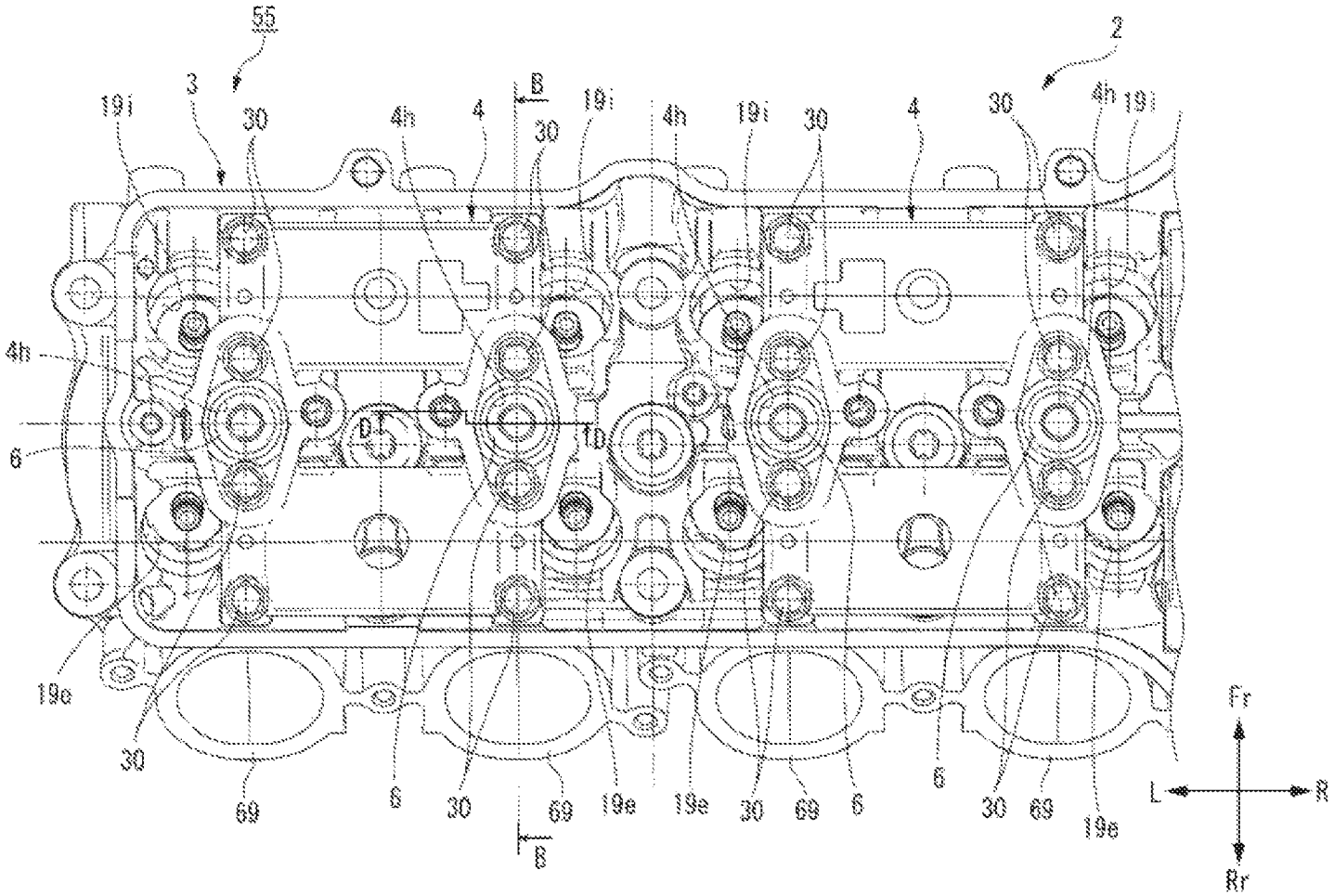
FIG. 3 is a sectional view taken along line A-A in FIG. 2.
Figure 4:
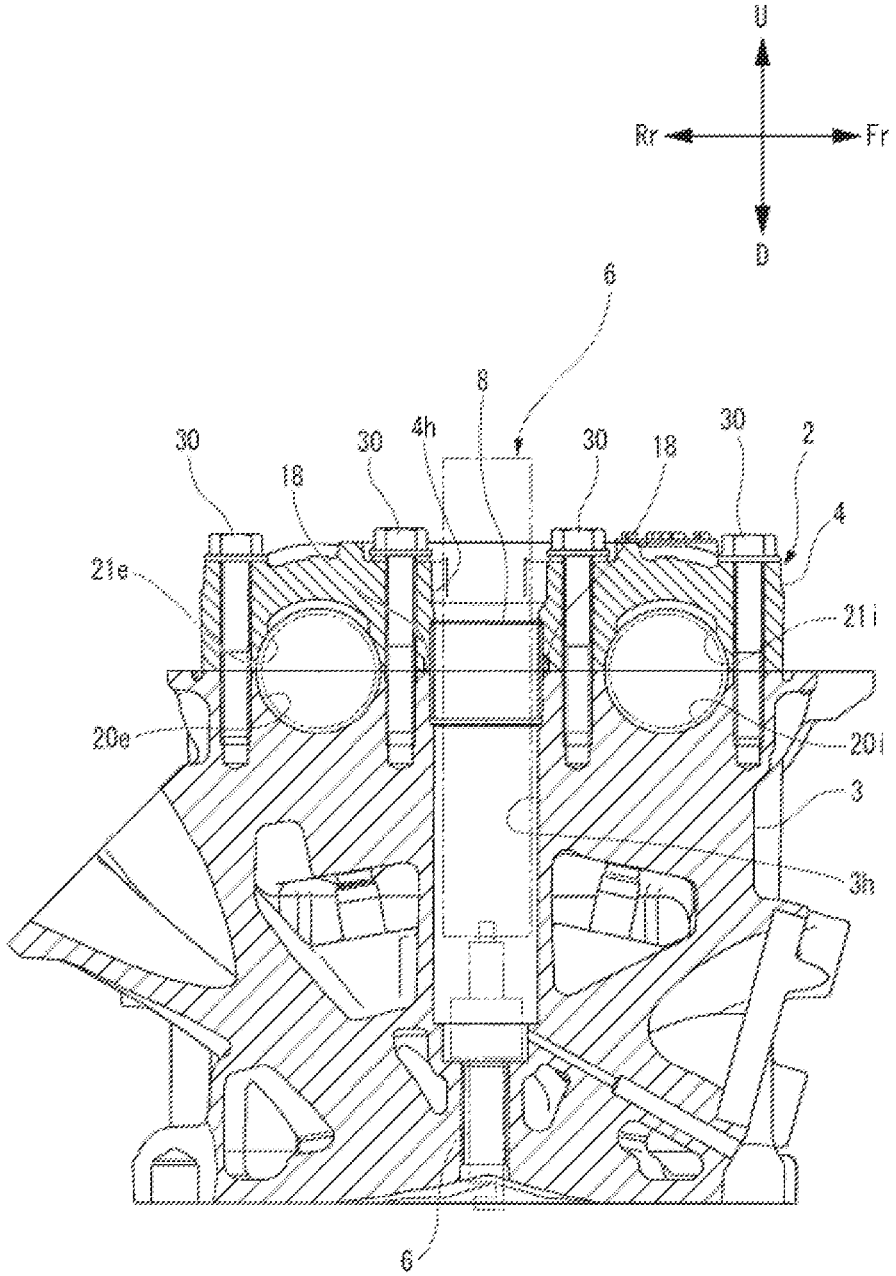
FIG. 4 is a sectional view taken along line B-B in FIG. 3.

As illustrated in FIGS. 3 and 4, the internal combustion engine 55 is an in-line four-cylinder water-cooled four-stroke internal combustion engine in which four cylinders are disposed in series. The cylinder head 2 of the internal combustion engine 55 has a structure in which the cam holder 4 is fixed to the upper side of the cylinder head main body 3. In the cylinder head main body 3, an intake port 19*i* and an exhaust port 19*e* are provided, and a main body side plug insertion hole 3*h* into which an ignition plug 6 is inserted is provided between the intake port 19*i* and the exhaust port 19*e*. The cam holder 4 is fixed to the cylinder head main body 3 with a fastening bolt 30 and forms an intake cam bearing portion 20*i* and an exhaust cam bearing portion 20*e* which rotatably support an intake camshaft 21*i* and an exhaust camshaft 21*e* which are disposed so as to sandwich the main body side plug insertion hole 3*h* together with the cylinder main body 3.

In the cam holder 4, a holder side plug insertion hole 4*h* into which the ignition plug 6 is inserted is formed in communication with the main body side plug insertion hole 3*h*.

Figure 5A:
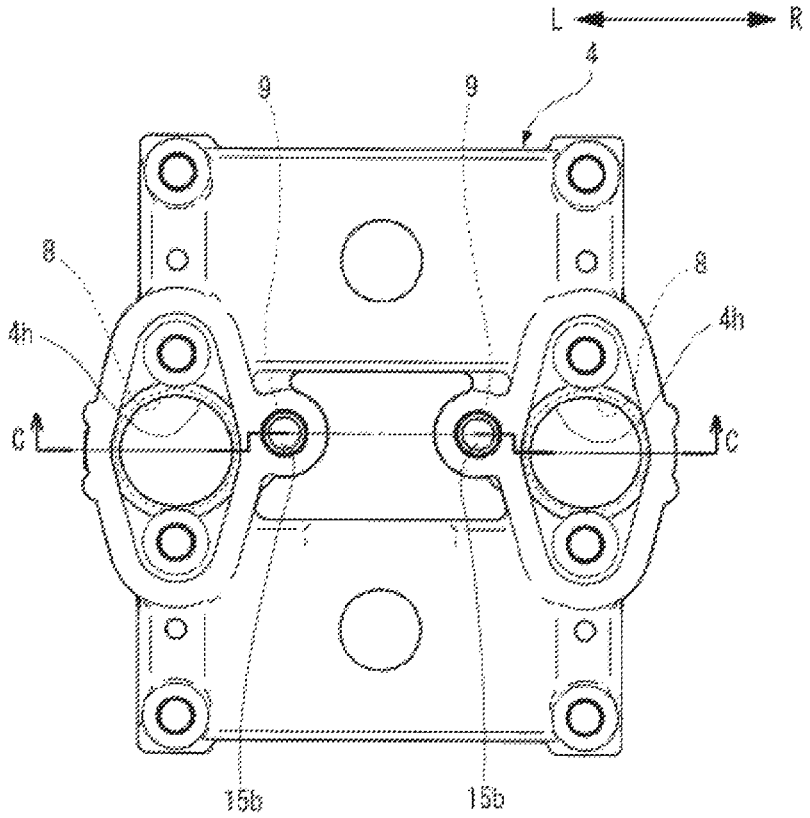
FIG. 5A is a plan view of a cam holder.

As described above, the internal combustion engine 55 of the embodiment is a four-cylinder internal combustion engine 55, and the cylinder head main body 3 includes a plurality of main body side plug insertion holes 3*h* into which the ignition plugs 6 that corresponds to each of the cylinders are inserted. Therefore, in the cam holder 4, a plurality of holder side plug insertion holes 4*h* which communicates with each of the main body side plug insertion hole 3*h* are formed, and in the embodiment, as illustrated in FIG. 5A, the cam holder 4 is integrated between the adjacent cylinders.

As illustrated in FIG. 4, one pair of fastening bolts 30 for fixing the cam holder 4 to the cylinder head main body 3 are provided to sandwich the intake camshaft 21*i* for each of the cylinders, and are provided to sandwich the exhaust camshaft 21*e*. Therefore, the thickness of the intake cam bearing portion 20*i* and the exhaust cam bearing portion 20*e* which rotatably support the intake camshaft 21*i* and the exhaust camshaft 21*e*, and the bolt hole through which the fastening bolt 30 is inserted is extremely thin.

Here, a knock pin 8 for restricting the assembly position of the cam holder 4 and the cylinder head main body 3 is provided in each of the main body side plug insertion hole 3*h* and the holder side plug insertion hole 4*h*. In other words, in the main body side plug insertion hole 3*h* and the holder side plug insertion hole 4*h* into which the ignition plug 6 is inserted, the knock pin 8 for restricting the assembly position of the cam holder 4 and the cylinder head main body 3 is provided across both of the insertion holes 3*h* and 4*h*. This knock pin 8 is a tubular member having substantially the same inner diameter as the diameter of the inner wall surface of the main body side plug insertion hole 3*h* and the holder side plug insertion hole 4*h*, and is provided in a state of being fitted into the inner wall surface of both of the insertion holes 3*h* and 4*h*.

Figure 5B:
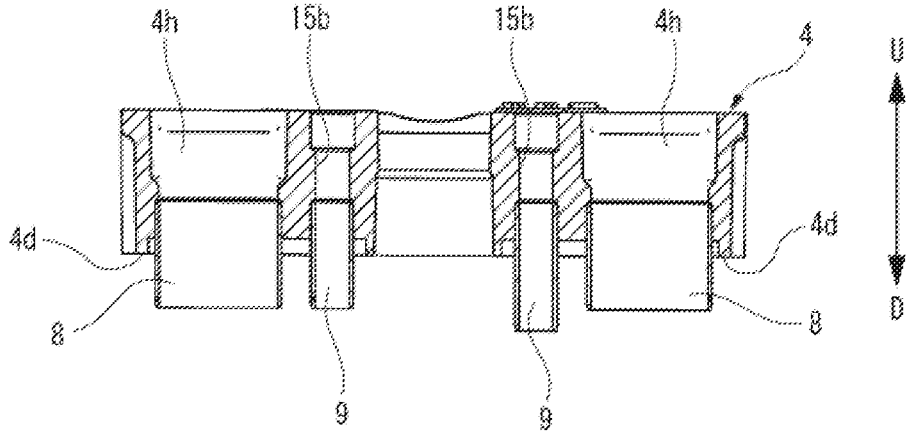
FIG. 5B is a sectional view taken along line C-C of FIG. 5A.

As illustrated in FIG. 5B, the knock pin 8 extends from the cylinder head side end 4*d* of the holder side plug insertion hole 4*h* and is provided integrally with the cam holder 4.

Figure 8:
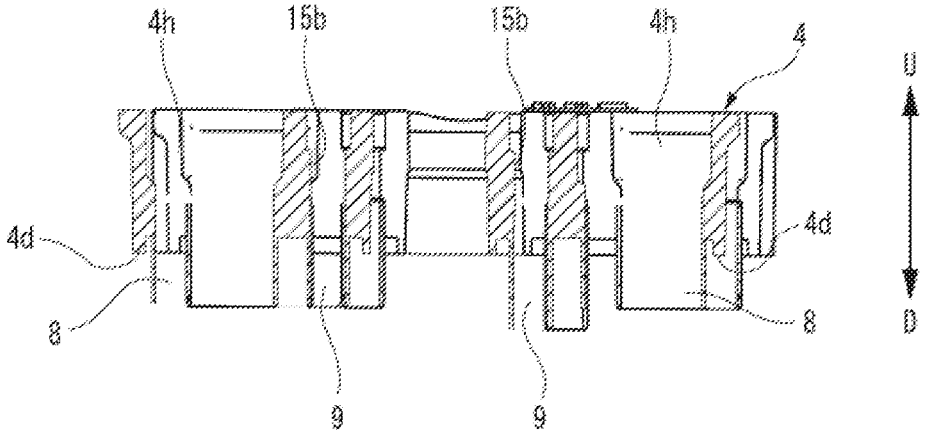
FIG. 8 is a sectional view illustrating a knock pin formed integrally with the cam holder.

The knock pin 8 which is provided integrally with the cam holder 4 may be formed separately from the cam holder 4 and may be integrated with the cam holder 4 by being press-fitted into the holder side plug insertion hole 4*h* of the cam holder 4, and as illustrated in FIG. 8, the knock pin 8 may be formed integrally with the cam holder 4. As the knock pin 8 is formed integrally with the cam holder 4, assembly of the knock pin 8 is unnecessary, and it is possible to reduce the number of components.

Figure 6:
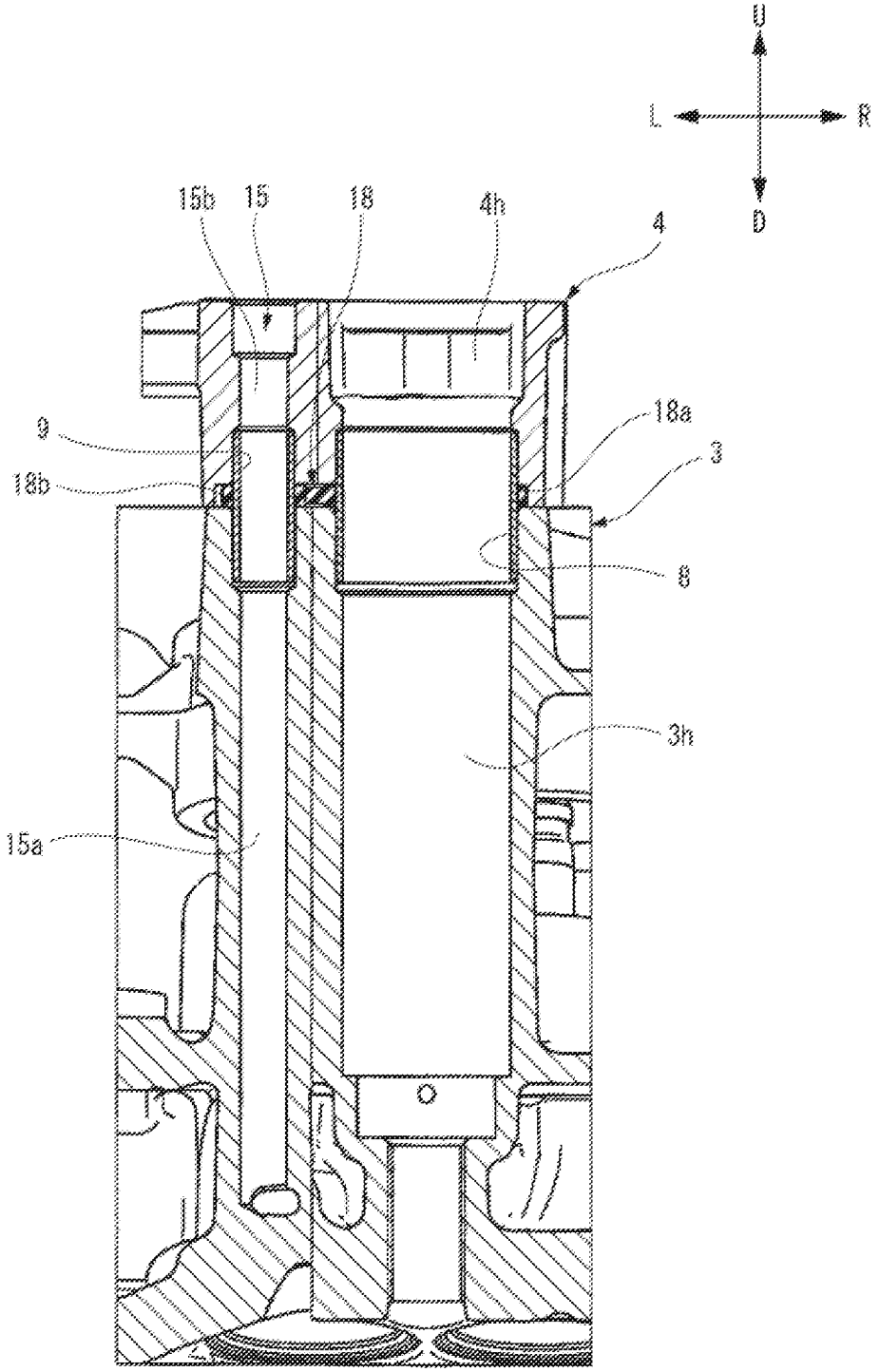
FIG. 6 is a sectional view taken along line D-D in FIG. 3.

As illustrated in FIGS. 5A to 6, a main body side air passage 15*a* is provided between adjacent main body side plug insertion holes 3*h* in the cylinder head main body 3, and a holder side air passage 15*b* which communicates with the main body side air passage 15*a* is provided in the cam holder 4. The main body side air passage 15*a* and the holder side air passage 15*b* form a secondary air passage 15.

The secondary air passage 15 is an air passage in which an air outlet is disposed in the vicinity of the exhaust port 19*e*, the outside air is suctioned into the vicinity of the exhaust port 19*e* due to the pulsation of the exhaust, and accordingly, the incomplete combustion gas of the exhaust gas is purified.

In the cylinder head 2 of the internal combustion engine 55, in addition to the knock pins 8 provided across the main body side plug insertion hole 3*h* and the holder side plug insertion hole 4*h*, a knock pin 9 for restricting the assembly position of the cam holder 4 and the cylinder head main body 3 is disposed across the main body side air passage 15*a* and the holder side air passage 15*b*.

At the outer circumference of the knock pin 8, as illustrated in FIG. 6, a seal member 18*a* having a rectangular section which seals a gap between the cylinder head main body 3 and the cam holder 4 is disposed. In addition, at the outer circumference of the knock pin 9, a seal member 18*b* having a rectangular section which seals a gap between the cylinder head main body 3 and the cam holder 4 is disposed.

Figure 7A:
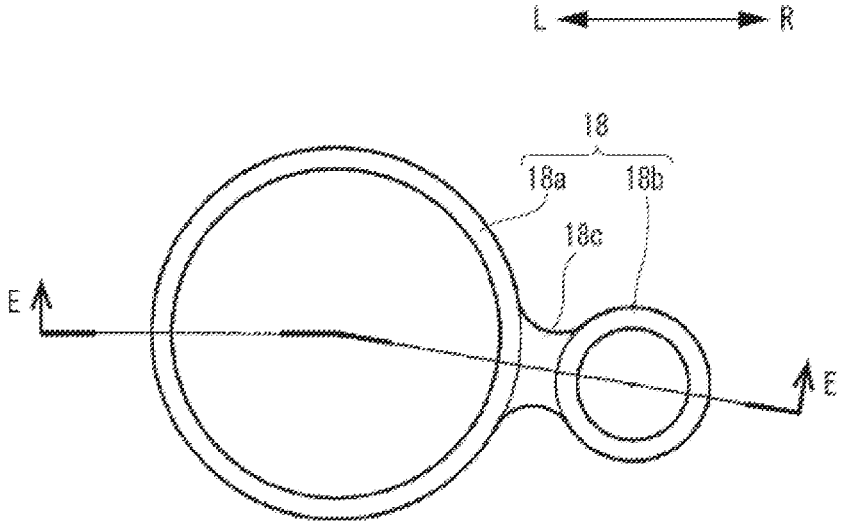
FIG. 7A is a plan view of a seal member.
Figure 7B:
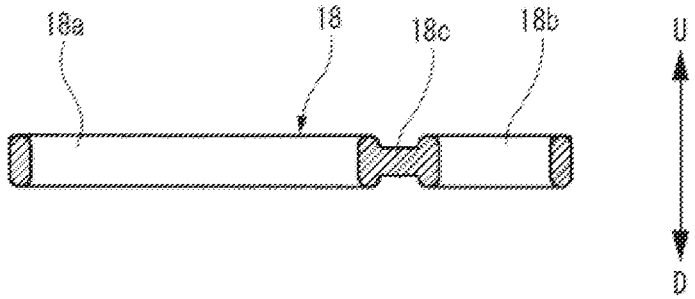
FIG. 7B is a sectional view taken along line E-E of FIG. 7A

Here, in the embodiment, as illustrated in FIGS. 7A and 7B, the seal member 18*a* and the seal member 18*b* are formed as one seal member 18 being integrated with each other via a connection portion 18*c*.

In the embodiment, since the knock pin 8 for restricting the assembly position of the cam holder 4 and the cylinder head main body 3 is disposed across the main body side plug insertion hole 3*h* into which the ignition plug 6 is inserted and the holder side plug insertion hole 4*h*, even in a case where there is no space for providing the knock pin 8 on the periphery of the fastening bolt 30 for assembling the cam holder 4 and the cylinder head main body 3, it is possible to prevent the positional shift by restricting the position at the time of assembling the cam holder 4 and the cylinder head main body 3 to each other.

Further, according to the embodiment, as the knock pin 8 is a cylindrical member integrally provided with the cam holder 4 so as to extend from the cylinder head side end portion 4*d* of the holder side plug insertion hole 4*h*, it is possible to omit attaching or detaching work of the knock pin 8 at the time of assembling or detaching the cam holder 4 to and from the cylinder head main body 3, and to improve workability of assembling and detaching the cam holder 4 and the cylinder head main body 3 to and from each other.

Further, according to the embodiment, since the knock pin 8 formed separately is press-fitted into the holder side plug insertion hole 4*h* of the cam holder 4 and is integrated with the cam holder 4, even when the shape of the cam holder 4 is made different, by preparing general-purpose knock pins 8, the knock pin 8 can also be employed in other models.

Further, according to the embodiment, since the internal combustion engine 55 is multi-cylinder, at least one cam holder 4 is integrated between the adjacent cylinders, and the knock pins 8 are provided in each of the main body side plug insertion holes 3*h* and the holder side plug insertion holes 4*h* in the integrated cam holder 4, it is possible to prevent the positional shift of the entire cam holder 4 with the plurality of knock pins 8 disposed side by side at the center of the cam holder 4. In addition, by integrating the cam holder 4, it is possible to reduce the number of cam holders 4.

Further, according to the embodiment, the cylinder head main body 3 includes the main body side air passage 15*a* between the adjacent main body side plug insertion holes 3*h*, in the cam holder 4, the holder side air passage 15*b* which communicates with the main body side air passage 15*a* is formed, the knock pin 9 for restricting the assembly position of the cam holder 4 and the cylinder head main body 3 is disposed across the main body side air passage 15*a* and the holder side air passage 15*b*, and accordingly, it is possible to improve positional shift prevention performance.

Further, according to the embodiment, since the seal member 18*a* having a rectangular section which seals the gap between the cylinder head main body 3 and the cam holder 4 is disposed at the outer circumference of the knock pin 8, the seal member 18*a* is compressed and deformed when the cam holder 4 is assembled and tightly adheres to the outer circumferential surface of the knock pin 8, and accordingly, it is possible to ensure sealing performance.

Further, according to the embodiment, since the seal member 18*b* provided at the outer circumference of the knock pin 9 provided on the secondary air passage 15 side and the seal member 18*a* provided at the outer circumference of the knock pin 8 provided on the plug insertion hole side are integrally formed, in addition to the reduction in number of components of the seal member, it is possible to mount the seal member simultaneously at two locations at the time of assembly work, and to improve workability.

Although the embodiment of the invention has been described above, the invention is not limited thereto, but can be appropriately modified. For example, in the above-described embodiment, the structure in which the cam holder 4 is integrated between the two cylinders is illustrated, but a structure in which three or more cylinders are integrated may be employed. In addition, although the seal member 18*a* is integrally formed with the seal member 18*b* provided at the outer circumference of the other knock pin 9, the invention is not limited thereto, and may not be integrated. In addition, in the above-described embodiment, the structure in which the knock pins 8 and 9 are integrally provided on the cam holder 4 is described, but may be integrally provided on the cylinder head main body 3.

The invention claimed is:

1. A cylinder head of an internal combustion engine comprising:

a cylinder head main body which is formed with a main body side plug insertion hole into which an ignition plug is inserted;

a cam holder which is fixed to the cylinder head main body and forms cam bearing portions together with the cylinder head main body, wherein the cam bearing portions are configured to rotatably support an intake camshaft and an exhaust camshaft, respectively, which are disposed to sandwich the main body side plug insertion hole, and wherein the cam holder is formed with a holder side plug insertion hole which communicates with the main body side plug insertion hole and into which the ignition plug is inserted;

a knock pin which is disposed across the main body side plug insertion hole and the holder side plug insertion hole to restrict assembly positions of the cam holder and the cylinder head main body; and a seal member which has a rectangular section and is disposed at an outer circumference of the knock pin between the cylinder head main body and the cam holder to seal a gap between the cylinder head main body and the cam holder, wherein the cylinder head main body is formed with a main body side air passage between adjacent main body side plug insertion holes, wherein the cam holder is formed with a holder side air passage which communicates with the main body side air passage, the cylinder head further comprising:

another knock pin which is disposed across the main body side air passage and the holder side air passage to restrict the assembly positions of the cam holder and the cylinder head main body, and wherein the seal member is integrally formed with a seal member which is disposed at an outer circumference of the other knock pin to seal a gap between the cam holder and the cylinder head main body.

2. A cylinder head of an internal combustion engine comprising:

a cylinder head main body which is formed with a main body side plug insertion hole into which an ignition plug is inserted;

a cam holder which is fixed to the cylinder head main body and forms cam bearing portions together with the cylinder head main body, wherein the cam bearing portions are configured to rotatably support an intake camshaft and an exhaust camshaft, respectively, which are disposed to sandwich the main body side plug insertion hole, and wherein the cam holder is formed with a holder side plug insertion hole which communicates with the main body side plug insertion hole and into which the ignition plug is inserted;

a knock pin which is disposed across the main body side plug insertion hole and the holder side plug insertion hole to restrict assembly positions of the cam holder and the cylinder head main body; and a seal member which has a rectangular section and is disposed at an outer circumference of the knock pin to seal a gap between the cylinder head main body and the cam holder, wherein the cylinder head main body is formed with a main body side air passage between adjacent main body side plug insertion holes, wherein the cam holder is formed with a holder side air passage which communicates with the main body side air passage, the cylinder head further comprising:

another knock pin which is disposed across the main body side air passage and the holder side air passage to restrict the assembly positions of the cam holder and the cylinder head main body, wherein the seal member is integrally formed with a seal member which is disposed at an outer circumference of the other knock pin to seal a gap between the cam holder and the cylinder head main body.

3. The cylinder head according to claim 2, wherein the knock pin is a tubular member which is provided integrally with the cam holder to extend from a cylinder head side end portion of the holder side plug insertion hole.

4. The cylinder head according to claim 3, wherein the knock pin is formed integrally with the cam holder.

5. The cylinder head according to claim 3, wherein the knock pin is formed as a separate member from the cam holder and is integrated with the cam holder by being press-fitted into the holder side plug insertion hole of the cam holder.

6. The cylinder head according to claim 2, wherein the internal combustion engine is a multi-cylinder engine, wherein the cylinder head main body is formed with a plurality of main body side plug insertion holes, into which ignition plugs corresponding to respective cylinders are inserted, wherein the cam holder is formed with a plurality of holder side plug insertion holes which respectively communicate with the main body side plug insertion holes of the cylinder head main body and into which the ignition plugs are inserted, respectively, wherein the cam holder is integrated for at least one pair of adjacent cylinders, and wherein the knock pin is provided across the main body side plug insertion hole and the holder side plug insertion hole in the integrated cam holder.

* * * * *